US010309165B2

(12) United States Patent
Michaud et al.

(10) Patent No.: US 10,309,165 B2
(45) Date of Patent: Jun. 4, 2019

(54) SLEEVE FOR FITTING AROUND A SPOOLING DRUM

(71) Applicant: Schlumberger Technology Corporation, Sugar Land, TX (US)

(72) Inventors: Christophe Michaud, Roissy-en-France (FR); Maxime Bouffe, Roissy-en-France (FR); Florent Canolle, Roissy-en-France (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 259 days.

(21) Appl. No.: 15/234,550

(22) Filed: Aug. 11, 2016

(65) Prior Publication Data

US 2017/0058618 A1 Mar. 2, 2017

(30) Foreign Application Priority Data

Aug. 25, 2015 (EP) ..... 15290220

(51) Int. Cl.
*B66D 1/36* (2006.01)
*B65H 57/04* (2006.01)
(Continued)

(52) U.S. Cl.
CPC ..... *E21B 19/008* (2013.01); *B65H 57/04* (2013.01); *B65H 75/26* (2013.01); *B65H 75/265* (2013.01);
(Continued)

(58) Field of Classification Search
CPC .. B65H 75/26; B65H 75/265; B65H 75/4415; B65H 2701/33; B65H 75/28; B65H 1/36;
(Continued)

(56) References Cited

U.S. PATENT DOCUMENTS 3,070,274 A * 12/1962 Elam ..... B65D 3/28 138/167
3,110,096 A * 11/1963 Bus, Sr. ..... B65H 75/265 242/602.1
(Continued)

FOREIGN PATENT DOCUMENTS

EP 694495 A1 * 6/1995
JP 2000086083 * 3/2000 ..... B65H 54/28
(Continued)

OTHER PUBLICATIONS

Extended Search Report issued in the related European Application 15290220.1, dated Mar. 21, 2016, (11 pages).

*Primary Examiner* — Michael R Mansen
*Assistant Examiner* — Raveen J Dias
(74) *Attorney, Agent, or Firm* — Michael Dae

(57) ABSTRACT

The disclosure relates to a sleeve for fitting around a spooling drum: the sleeve comprises at least a groove for receiving a conveying element to be spooled around the drum, is made of flexible material and is configured so as to be able to take a first configuration in which the sleeve forms a flat sheet, the groove extending in a direction, called spooling direction, and a second configuration in which the sleeve forms a cylinder, with the groove is situated on an external face of the cylinder.

9 Claims, 4 Drawing Sheets

(51) Int. Cl.

| | |
|---|---|
| ***B65H 75/26*** | (2006.01) |
| ***B65H 75/44*** | (2006.01) |
| ***E21B 19/00*** | (2006.01) |
| ***E21B 33/08*** | (2006.01) |
| ***B66D 1/30*** | (2006.01) |

(52) U.S. Cl.
CPC ..... *B65H 75/4415* (2013.01); *B66D 1/30* (2013.01); *B66D 1/36* (2013.01); *E21B 33/08* (2013.01); *B65H 2701/33* (2013.01)

(58) Field of Classification Search
CPC ..... B65H 1/38; B65H 54/04; B65H 55/04; B65H 55/00; B65H 75/18; B65H 75/141; B65H 2701/31; B65H 54/48; B65H 54/485; E21B 19/008; E21B 19/02; E21B 19/00; B65D 1/36; B65D 1/30; B65D 2700/0191; B65D 85/676
USPC ..... 242/602, 602.1, 602.2, 602.3, 118.32, 242/118.4, 118.7, 613
See application file for complete search history.

(56) References Cited

U.S. PATENT DOCUMENTS 3,321,185 A * 5/1967 Zenke ..... B66D 1/30 242/388
3,391,443 A * 7/1968 Bus, Sr. ..... B66D 1/36 242/602.2
3,918,218 A * 11/1975 Zoiss ..... B24D 3/344 51/295
4,034,932 A * 7/1977 Ferch ..... B65H 75/265 242/602.2
5,067,665 A * 11/1991 LoStracco ..... B65H 55/04 242/118.32
5,449,128 A * 9/1995 Crisci, Jr. ..... B65H 75/141 242/580
6,297,455 B1 10/2001 Wijnberg et al.
6,637,689 B1 * 10/2003 Vega ..... B65H 75/141 206/400
6,792,712 B1 * 9/2004 Houg-Blymyer ..... A01K 97/06 24/16 PB
7,652,592 B2 1/2010 Le Briere et al.
2013/0062076 A1 3/2013 Bernal et al.
2017/0198530 A1 * 7/2017 McFarland ..... E21B 23/14

FOREIGN PATENT DOCUMENTS

| | | | |
|---|---|---|---|
| JP | 2000086083 | A | 3/2000 |
| WO | WO00/10903 | A1 * | 8/1999 |
| WO | 2006027553 | A1 | 3/2006 |
| WO | 2013098280 | A2 | 7/2013 |

* cited by examiner

SLEEVE FOR FITTING AROUND A SPOOLING DRUM

CROSS-REFERENCE TO RELATED APPLICATIONS

The present application claims priority to EP Application Serial No. 15290220.1, which was filed on 25 Aug. 2015, and is incorporated herein by reference in its entirety.

The disclosure relates to a sleeve for fitting around a spooling drum, an assembly of a spooling drum and such sleeve, an installation for lowering a conveying element such as a cable in a borehole with such assembly and a method for fitting such sleeve around a spooling drum.

BACKGROUND

Sleeves for fitting around spooling drums are known in the art. Such sleeve may comprise grooves for receiving a cable. A sleeve generally comprises two half-cylinders that are manufactured by a molding technique and are assembled together on a spooling drum. The assembly of the sleeve and the spooling drum may be used for lowering a cable in a wellbore.

SUMMARY

The sleeve according to the disclosure comprises at least a groove for receiving a cable to be spooled around the drum. It is made of flexible material and may take a first configuration in which the sleeve forms a flat sheet, the groove extending in a spooling direction, and a second configuration in which the sleeve forms a cylinder having the groove situated on an external face of the cylinder.

Such sleeve may be manufactured very easily, a same manufacturing tool being able to manufacture sleeves for drums having different diameters and heights, therefore enabling to provide sleeves with low manufacturing costs. Such sleeves may be fitted on different drums of a specific type of drum presenting small diameter variations relative to each other due to manufacturing process of the drum. The disclosure also relates to an assembly of a spooling drum and a sleeve for fitting around the drum, with the sleeve having grooves extending along a spooling direction for receiving a cable to be spooled around the drum. The sleeve is made of a flexible material and takes a first configuration in which it forms a flat sheet with the groove extending along a spooling direction, and a second configuration in which it forms a cylinder of a circumference corresponding to the circumference of the drum, with the groove situated on an external face of the cylinder.

The disclosure also relates to an installation for lowering a cable in a borehole, comprising an assembly as mentioned above, with the sleeve fitted around the drum.

The disclosure also relates to a method for fitting a sleeve on a spooling drum, including:

- Forming grooves for receiving a cable along a spooling direction in a flat sheet of flexible material,
- Configuring the flat sheet so that a dimension of the sheet corresponds to the circumference of the drum,
- Bending the flat sheet so that it forms a cylinder wound around the drum so that the grooves extend on an external face of the drum.

BRIEF DESCRIPTION OF THE DRAWINGS

Various aspects of this disclosure may be better understood upon reading the following detailed description and upon reference to the drawings in which.

DETAILED DESCRIPTION

Figure 1A:
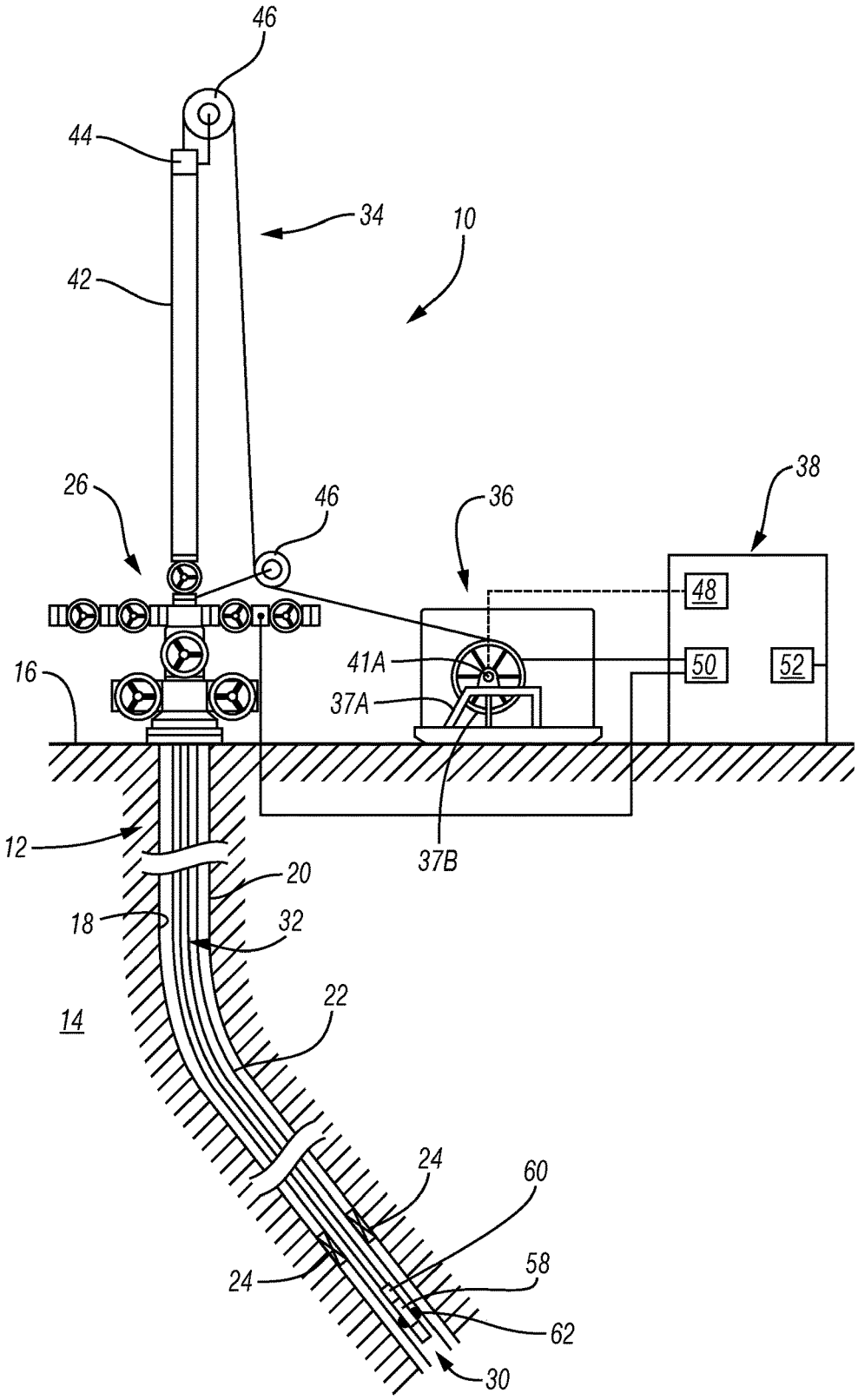
FIG. 1A is a schematic drawing of an installation for lowering a downhole tool in a borehole with a cable, according to one or more aspects of the disclosure.

One or more specific embodiments of the present disclosure will be described below. These described embodiments are examples of the presently disclosed techniques. Additionally, in an effort to provide a concise description of these embodiments, some features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

An intervention installation 10 according to the disclosure is illustrated in FIG. 1. This installation 10 is intended to perform operations in a fluid production or injection well 12 made in the subsoil 14.

These operations are applied by means of a downhole assembly 30 for carrying out actions, such as perforations, cuttings by means of a torch, cementation operations, jarring operations or further operations for setting tools into place such as setting into place a seal gasket or anchoring of a tool, and/or perform measurements, such as sampling, resistivity measurement, nuclear measurement, etc. at the bottom of the well 12.

These interventions are carried out in any point of the well 12, from the surface 16.

The fluid produced in the well 12 is for example a hydrocarbon such as petroleum or natural gas and/or another effluent, such as steam or water, the well is an "injector" well into which liquid or gas is injected. The production tubing may contain one or several different types of fluid.

The well 12 is made in a cavity 18 positioned between the surface 16 of the ground and the fluid layer to be exploited (not shown) located in depth in a formation of the subsoil 14.

The well 12 generally includes an outer tubular duct 20, designated by the term of "casing", and formed for example by an assembly of tubes applied against the formations of the subsoil 14. The well 12 may also include at least one inner tubular duct 22 with a smaller diameter mounted in the outer tubular duct 20. In certain cases, the well 12 is without any duct 20, 22.

The inner tubular duct 22 is generally designated as "production tubing". It is formed with a metal assembly of metal tubes. It is wedged inside the outer tubular duct 20 for example by linings 24.

The well 12 includes a well head 26 at the surface which selectively closes the outer tubular duct 20 and said or each inner tubular duct 22. The well head 26 includes a plurality of selective access valves inside the outer tubular duct 20 and inside the inner tubular duct 22.

The intervention installation 10 includes an intervention device comprising an intervention and measurement downhole assembly 30 intended to be lowered into the well 12 through the inner tubular duct 22, and a conveying cable 32 for deploying the downhole assembly 30 in the well 12.

The intervention installation 10 further includes a sealing and alignment assembly 34 of the cable 32, mounted on the well head 26, an assembly 36 for deploying the cable 32, positioned in the vicinity of the well head 26, and a surface control unit 38.

The sealing and alignment assembly 34 comprises an airlock 42 mounted on the well head 26, a stuffing box 44 for achieving the seal around the cable 32 and return pulleys 46 respectively attached on the stuffing box 44 and on the well head 26 in order to send back the cable 32 towards the deployment assembly 36.

The airlock 42 is intended to allow introduction of the downhole assembly 30 into the well 12.

The stuffing box 44 is capable of achieving a seal around the cable 32, for example via annular linings applied around this surface or/and by injecting a fluid between the outer surface and the wall of the stuffing box 44.

In a so-called "open well" or "open hole" alternative, in which there is no casing 20, the assembly 34 is exclusively an assembly for aligning the cable, without any sealing device.

A deployment assembly 36 includes a winch 37A provided with a drum 37B. The winch 37A and its drum 37B are laid on the ground or are optionally loaded onboard a vehicle (not shown). A spooling sleeve may be fitted around the drum 37B, as will be described later. The winch 37A is capable of winding or unwinding a given length of cable 32 for controlling the displacement of the downhole assembly 30 in the well 12 when moving up or down respectively. An upper end 41A of the cable may be attached onto the drum 37B.

The installation also comprises a surface control unit 38 including a processor unit 48 and a first telemetry unit 50 for communicating with devices situated at the well site, for instance the winder 37B and optionally the downhole assembly 30, and a second telemetry unit 52 for communication with computers remote from the well site.

The downhole assembly 30 may comprise a hollow case comprising an operating assembly 58 comprising one or several measuring module and tools such as jarring tools or perforating tool. The measuring module and tools may be capable of being controlled from the surface by electrical signals transmitted through the cable 32. In alternative embodiments, they are launched without communicating with the surface via programming unit in the downhole tool.

When communicating with the surface, the downhole assembly also comprises a telemetry module 60 for communicating with the surface control unit 38 via the cable 32. The downhole assembly also comprises contacting elements 62 for contacting with duct 22 in order to enable communication with the downhole assembly. The communication is performed via known method, such as the one disclosed in U.S. Pat. No. 7,652,592 hereby incorporated by reference. In other embodiments, the cable may be connected to the downhole assembly thanks to a capacitive coupling at the head of the well as disclosed in application No WO2013/098280 for instance. As already indicated, such communication is optional.

In the installation described in relation with FIG. 1, the cable 32 is a slickline cable. It has a central metal core, and may also comprise an insulating outer sheath applied around the central core. The central core is formed by a single strand of solid metal cable, designated by the term "piano wire". An example of such slickline cable 32 is also disclosed in patent application No. US 2013/0062076 hereby incorporated by reference. However, the slickline may take any appropriate configuration enabling to lower a downhole tool in the wellbore.

Figure 1B:
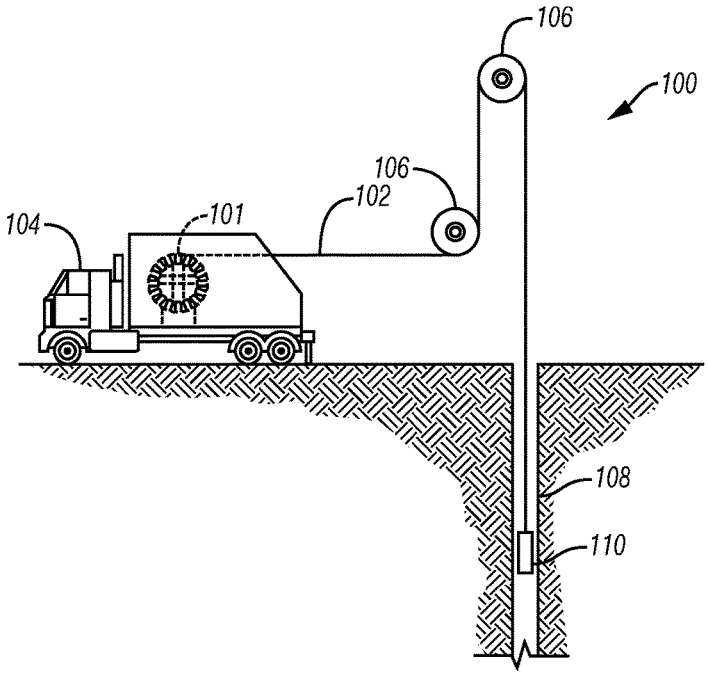
FIG. 1B is a schematic drawing of another installation for lowering a downhole tool in a borehole with a cable, according to one or more aspects of the disclosure.

FIG. 1B shows an installation 100 according to another embodiment of the disclosure. The installation comprises a drum 101 having a wireline cable 102 spooled thereon and being used in a typical wireline oil well application. A spooling sleeve may be fitted around the drum 101, as will be described later.

As shown in FIG. 1A, the drum 101 is typically brought to a well site on the back of a truck 104 and stored thereon during an wireline oil well operation. Once on site, the wireline cable 102 is connected to a pair of sheave wheels 106, which guide the cable 102 from the drum 101 to a wellbore 108. An end of the cable 102 is connected to a wireline tool 110, which may be any appropriate tool for carrying out a wireline oil well operation, such as a logging tool. The wireline tool 110 may for instance include a plurality of sensors, such as sensors for sensing the temperature, pressure, etc, in the wellbore and/or sensors for determining properties of the wellbore such as resistivity sensor, nuclear sensor, sampling tool, etc.

The wireline cable 102 is configured to transmit power from the truck 104 to the wireline tool 110 and comprise a plurality of conductors to do so. An example of wireline cable is described in U.S. Pat. No. 6,297,455, herein incorporated by reference. Any other wireline cable may however be used in an installation according to the disclosure such as the one of FIG. 1B.

An installation according to the disclosure may also comprise an installation for lowering a downhole tool in a wellbore via any type of conveying element, such a coiled tubing.

It also has to be understood that the sleeve and the assembly described below are used in oil and gas applications but may be used in any type of applications necessitating the winding or unwinding a cable.

A sleeve according to a first embodiment of the disclosure will be described below in reference to FIG. 2.

The sleeve 200 according to the first embodiment of the disclosure, shown here in a first configuration is a flat sheet. It is made of a flexible material such as a plastic or a metallic material, in particular Polyvinyl chloride (PVC). The thickness of the sheet may be inferior to 10 mm, in particular to 5 mm to enhance its flexibility. The sheet has a rectangular shape.

Figure 2:
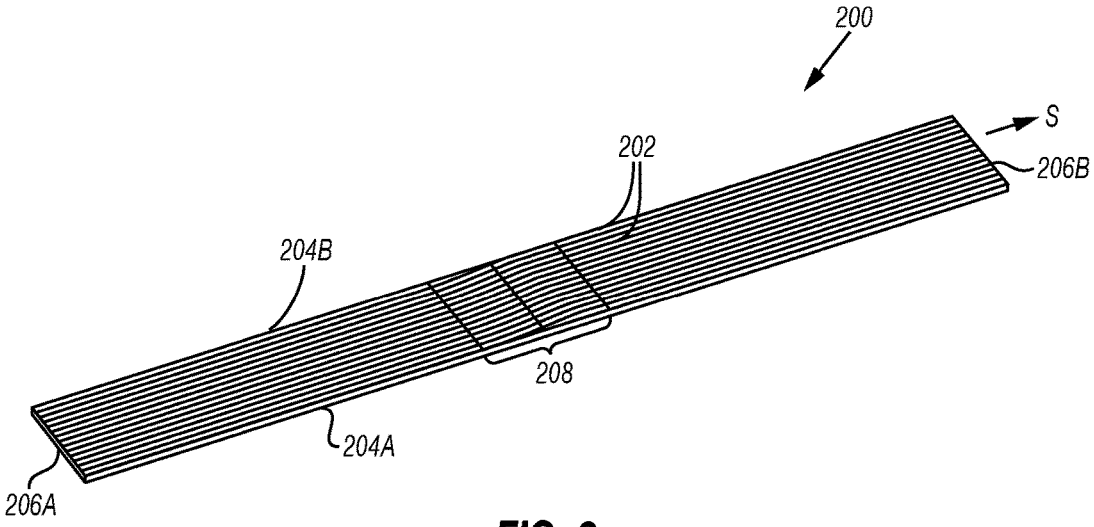
FIG. 2 is a view of a first sleeve according to a first embodiment of the disclosure, in a first configuration.

As can be seen from FIG. 2, the sleeve 200 comprise a plurality of grooves 202 extending along a predetermined direction, called spooling direction. The spooling direction S is parallel to the direction of the longitudinal sides 204A, 204B of the sheet. Each of the grooves 202 extends from one of the lateral side 206A to the opposing lateral side of the sheet and the grooves are adjacent to each other so that the entire sheet is covered with grooves.

As can also be seen on FIG. 2, each of the groove may comprise a break portion 208 extending along a direction tilted from a non-zero angle relative to the spooling direction. The break portion extends between two portions of the groove extending along the spooling direction. The grooves 507 may also be arranged as disclosed in U.S. Pat. No. 3,391,443 or in any appropriate manner.

The sleeve of FIG. 2 is shown here in a first configuration but may take a second configuration in which it forms a cylinder. In the second configuration, the sheet is bent around an axis perpendicular to the spooling direction and in the plan of the sheet, so that the grooves form peripheral grooves on the external side surface of the cylinder. In this configuration, the sleeve may be fitted on the drum, with the sides 204A, 204B contacting flanges of the drum, situated at each axial extremity of the drum and the sides 206A, 206B being in contact with each other.

In the second configuration, in view of the sides 206A, 206B being in contact with each other the grooves 202 form a continuous helical groove extending from an axial extremity of the drum to the other, guiding a cable spooled on the drum to a predetermined arrangement having a predetermined number of turns around the drum (corresponding to the number of grooves on the flat sheet).

It may be noted that the sides 206A, 206B may not be in contact with each other once the sheet is wound around the drum due to slight variation of the drum diameter compared to a reference diameter in view of the manufacturing process. However, even if there is a gap between sides 206A, 206B in the second configuration, the sleeve is still able to guide the cable so that it is spooled properly around the drum.

Figure 3:
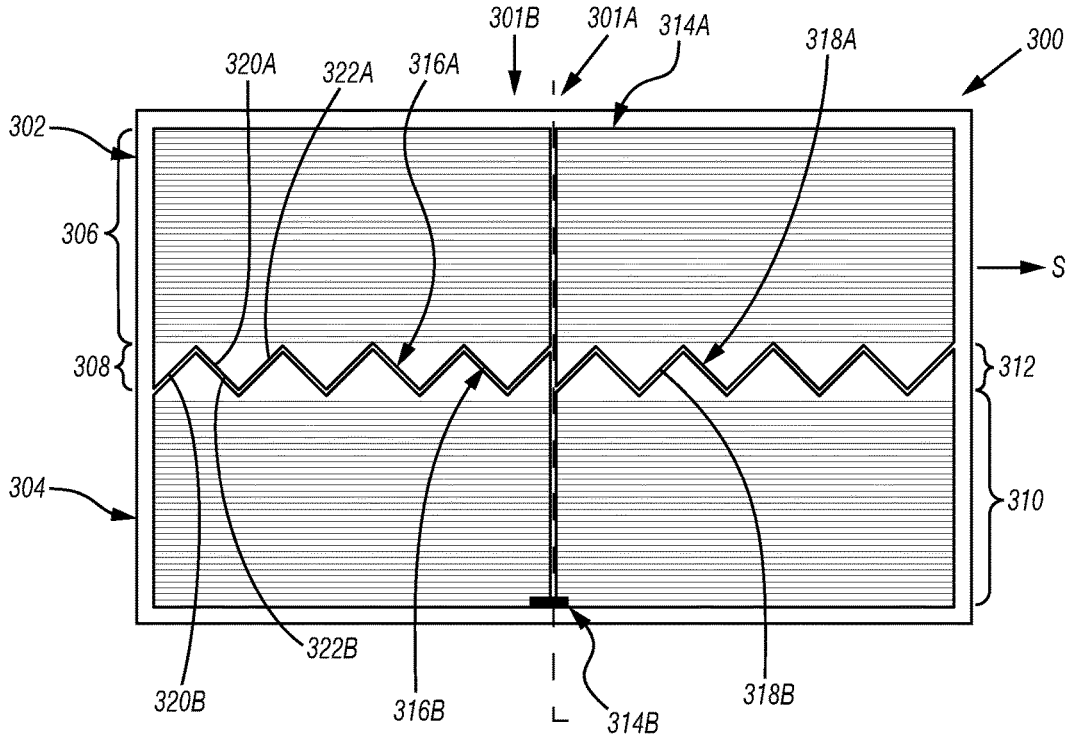
FIG. 3 is a view of a second sleeve according to a second embodiment of the disclosure, in a first configuration.

Another sleeve according to another embodiment of the disclosure is shown on FIG. 3.

This sleeve 300 in the first configuration is also a rectangular flat sheet, for instance a sheet similar to the one disclosed above. The sheet is made of two sheets 301A, 301B assembled together and contacting along a line L perpendicular to the spooling direction S. The sheets 301A, 301B are fixed together by any appropriate mean, for instance via an adhesive tape on the attaching the sheets 301A, 301B. The sleeve may be made of any number of sheets attached together or of one sheet. Further, contrary to the first embodiment presented above, the sleeve comprises two longitudinal parts 302, 304 as will be described below.

Each part 302, 304 comprises two zones respectively 306, 308 and 310, 312. Each of the first zones 306; 310 comprises a plurality of groove extending in a spooling direction, as shown in relation with FIG. 2. The first zone 306; 310 of both parts 302, 304 is situated at a first end respectively 314A, 314B of the part in a direction perpendicular to the spooling direction. The first zone may comprise grooves with one or two break portions, as described above. It will not be described in further details as it is very similar to what has been disclosed in relationship with FIG. 2. The first zones may extend on more than 80%, in particular more than 90%, of the surface of the sheet.

The second zone 308, 312 of each part 302, 304 is devoid of grooves. It is situated at a second end, respectively 316A, 316B of the part 302, 304 in the direction perpendicular to the spooling direction. As can be seen on FIG. 3, the edges, called attachments edges 318A, 318B of the parts 302, 304 at ends 316A, 316B have complementary shapes so that, when the parts are positioned adjacent to each other, the edges are contacting each other on their whole length. When positioned adjacent to each other, the parts 302, 304 to form the sheet of rectangular shape. The sheet has therefore a central strip devoid of grooves in the direction perpendicular to the spooling direction formed by the contacting second zones 308, 312 of the parts 302, 304.

The attachment edges 318A, 318B each comprise a plurality of edge portions 320A, 322A; 320B, 322B and are configured so that the total length of the edge portions having a tangent situated in the spooling direction is less than 50%, in particular less than 20% of the dimension of the sleeve along the spooling direction. In FIG. 3, first edge portions 320A; 320B are tilted relative to the spooling direction from a predetermined angle while second edge portions 322A, 322B are tilted relative to the spooling direction from an opposite angle (same value but opposite rotating direction). In other words, the attachment edge 318A, 318B of each part forms a zig zag shape.

As it has been described for FIG. 2, in the second configuration, the sleeve is bent for forming a cylinder having an axis perpendicular to the spooling direction, so that the sides 314A, 314B contact flanges of the drum, situated at each axial extremity of the drum.

Figure 4:
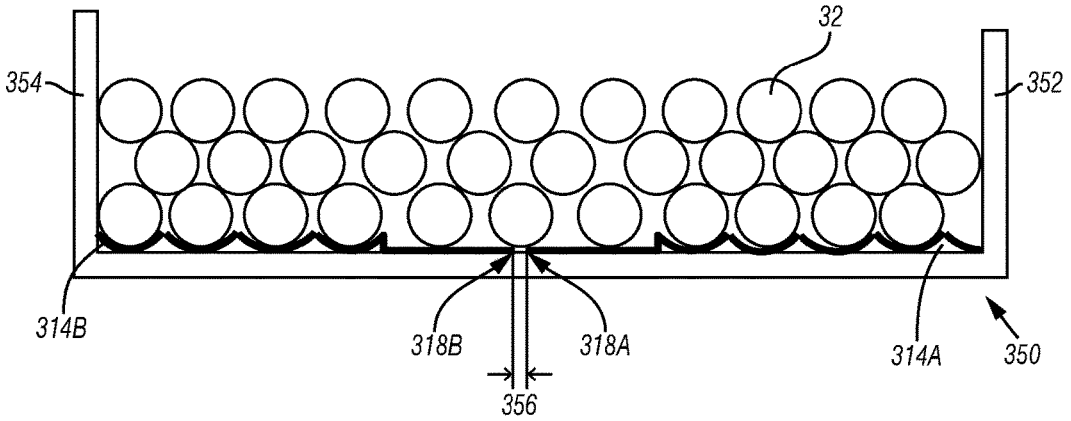
FIG. 4 is a sectional view of an assembly of a drum with the second sleeve in a second configuration

FIG. 4 shows a sectional view of an assembly of a drum on which is fitted a sleeve according to FIG. 3, the sleeve being in the second configuration.

FIG. 4 shows a drum 350 comprising flanges 352, 354 at both of its axial extremities. As indicated before, the sleeve 300 is fitted on the drum so that each of the ends 314A, 314B of the sleeve are close to the flanges 352, 354. However, due to manufacturing dimensional uncertainties, the drum may be slightly longer than expected which may create a gap 356 corresponding to the difference between the dimension of the sleeve and the dimension of the drum along the axial direction. Such gap may create perturbation in the spooling of the cable.

However, with the sleeve 300, the gap 356 is positioned between the two parts of the sleeve so that in the vicinity of the flanges 352, 354, the position of the cable is precisely set. Further, the gap 356 is between both second zones devoid of grooves enabling to handle more freedom in the positioning of the cable in these zones. Thus, the repartition of the turns of cable may be adapted as a function of the gap. The gap may be distributed between different turns of cable 32 so as to avoid perturbation of the spooling.

Further, as the pattern of the attachment edges is chosen so that edge portions having a tangent situated in the spooling direction are less than 20% of the dimension of the sheet in the spooling direction, i.e. of the perimeter of the sleeve, the gap has the same shape and the cable does not get stuck in the gap even if its dimension in the axial direction of the drum is of the same order as the diameter of the cable 32.

A particular embodiment of a sleeve for obtaining this adjusting effect has been described here. However, sleeves with other architecture may also be used for obtaining a similar effect. For instance, a sleeve may comprise three parts, so that the parts form a sheet with two central strips in the first configuration. In this case, the central part of the sleeve may comprise two second zones at end of its ends along the direction perpendicular to the spooling direction when the sheet is in the first configuration. The sleeve may also comprise any number of parts.

Also the pattern of the attachment edges may not be limited to the one disclosed above. Each attachment edge may be rectilinear such that it has a direction tilted relative to a spooling direction or have a sinusoidal shape.

Other sleeve architecture may of course also be considered.

Figure 5:
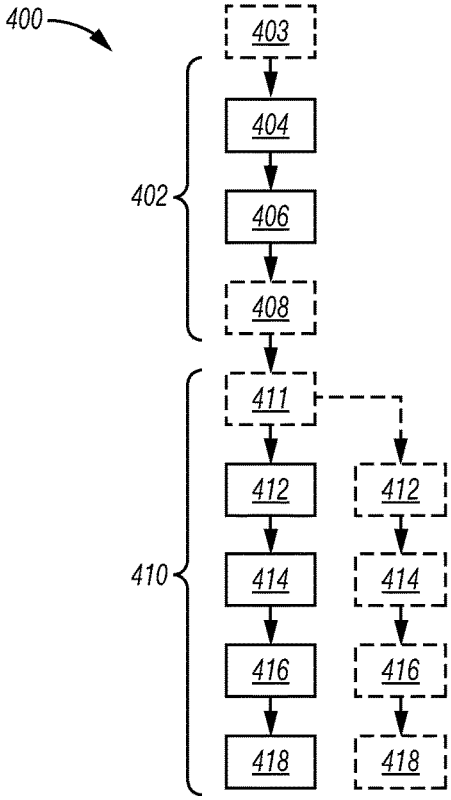
FIG. 5 is a flowchart of a method of fitting the sleeve around a drum according to one or more aspects of the disclosure

A fitting method 400 of a sleeve according to the disclosure on a drum is now disclosed with reference to FIG. 5.

First, the method 400 comprise manufacturing the sleeve (box 402). Manufacturing includes forming grooves on a sheet of a flexible material (box 404). The grooves may be formed in the sheet with a conventional milling tool. Optionally, the method may comprise attaching several sheets together as described in relationship with FIG. 3, before forming the grooves for instance with an adhesive tape (box 403). The manufacturing may then comprise configuring the sheet so that the dimension of the sheet along the spooling direction corresponds to the circumference of the drum on which it will be fitted (box 406). It may comprise cutting the sheet according to the dimensions of the drum. When the sleeve is in several parts, the method may also include cutting the sheet so that it forms separate longitudinal parts along a predetermined pattern (box 408).

It may be also considered that the formation of the grooves on the sheet may be performed after the configuring of the sheet so that it matches the dimension of the drum and the separating of the parts of the sheet. When the sheet comprise several parts, the parts may also come from different sheets and be machined separately.

Such manufacturing is relatively cheap as the same milling and cutting tools may be used for manufacturing sleeve fitting on drums of various ranges of diameter, contrary to a molding method. As also explained, such sleeve is easy to bend on any drum even if the diameter of the drum is not exactly the reference diameter due to manufacturing uncertainties.

Then, when the sleeve is manufactured in the first configuration, it is fitted on the drum (box 410). The fitting comprise bending the sleeve around the drum (box 412) and attaching it with a temporary attaching element such as a strap (box 414). The fitting method then comprise partially spooling the cable around the sleeve (box 416) and, when the cable has performed a predetermined number of turns around the sleeve, detaching the temporary attaching element (box 418). The tension applied by the cable 32 on the sleeve indeed enables the sleeve to stay in the second configuration around the drum.

In particular, when the sleeve comprise several different parts as the sleeve of FIG. 3, the method may also comprise adjusting the relative position of each part of the sleeve on the drum (box 411) before bending the sleeve around the drum. Adjusting the sleeve may comprise choosing the position of each part so that it contacts with the corresponding flange of the drum for instance.

In this case, the bending, temporary attachment, spooling and detaching of the temporary attachment element may be performed independently for each part.

Figure 6:
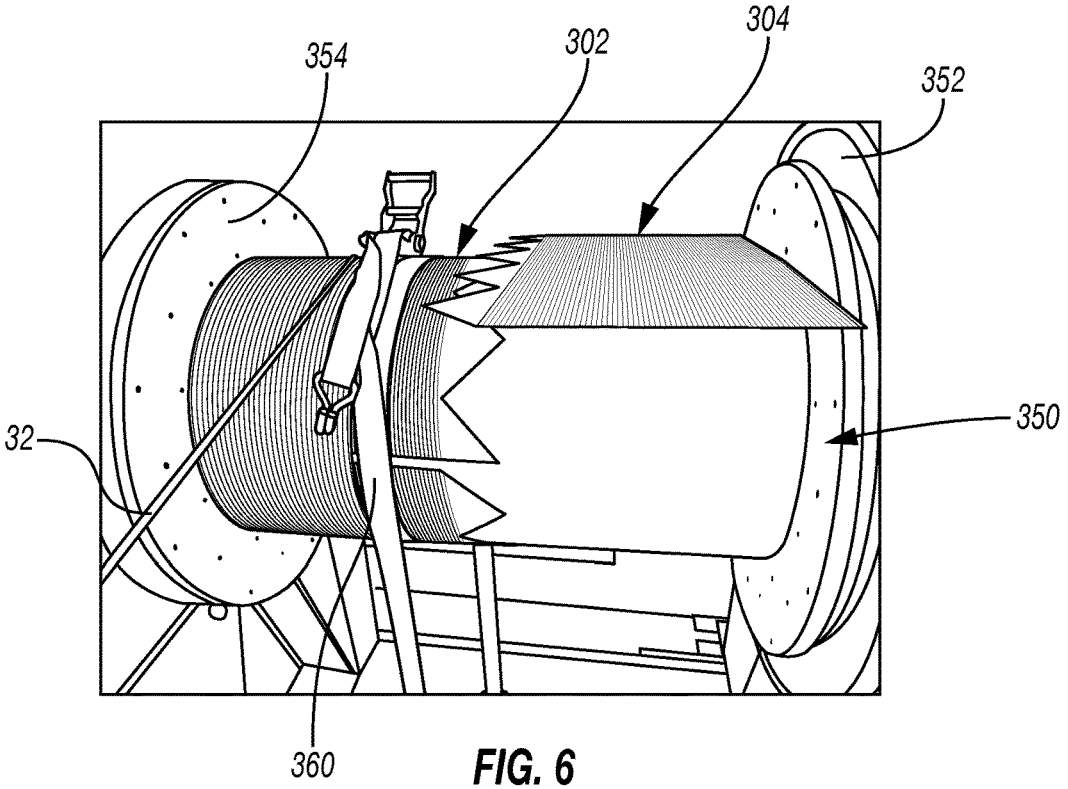
FIG. 6 is a view of the second sleeve during its installation on a drum.

FIG. 6 shows for instance an assembly of a drum and the sleeve of FIG. 3 during the fitting of the sleeve on the drum. As can be seen, both parts 302, 304 have been positioned on the drum. Part 302 has been bent and is maintained with a strap 360 and cable is already spooled partially on this part while part 304 has not been bent around the drum yet.

Such sleeve may be used in particular for applications in which the cable will not be unspooled totally at each use in order to avoid repositioning the sleeve around the drum after each job. It is for instance the case of the oil and gas related applications.

In view of the entirety of the present disclosure, including the figures, a person skilled in the art should appreciate that they may readily use the present disclosure as a basis for designing or modifying other processes and structures for carrying out the same uses and/or achieving the same aspects introduced herein. A person skilled in the art should also realize that such equivalent constructions do not depart from the spirit and scope of the present disclosure, and that they may make various changes, substitutions and alterations herein without departing from the spirit and scope of the present disclosure. For example, although the preceding description has been described herein with reference to particular means, materials and embodiments, it is not intended to be limited to the particulars disclosed herein; rather, it extends to functionally equivalent structures, methods, and uses, such as are within the scope of the appended claims.

Anyway, the disclosure relates to a sleeve for fitting around a spooling drum, wherein the sleeve comprises at least a groove for receiving a conveying element to be spooled around the drum, wherein the sleeve is made of flexible material and is configured so as to be able to take a first configuration in which the sleeve forms a flat sheet, the groove extending in a direction, called spooling direction, and a second configuration in which the sleeve forms a cylinder, wherein the groove is situated on an external face of the cylinder.

The sleeve may comprise a plurality of adjacent grooves. The adjacent grooves may form a continuous helical groove when the sleeve is in the second configuration.

The sleeve may also be configured so that, in the second configuration, the spooling direction is perpendicular to the axis of the cylinder.

At least a groove comprises at least a break portion extending along a direction that forms a non-zero angle with the spooling direction. At least a groove may comprise a plurality of break portions.

At least a groove may also extend from one end of the sleeve relative to the spooling direction to the opposite end of the sleeve.

The sleeve may also comprise at least first zone comprising a plurality of grooves extending along the spooling direction from an end to the opposite end of the sleeve relative to the spooling direction and at least a second zone deprived of grooves.

The sleeve may also comprise at least two parts, such as longitudinal parts, wherein at least two of the parts comprise:

the first zone, the second zone, at least at a first end of the part relative to a direction perpendicular to the spooling direction.

The sleeve may also be configured so that, when the parts are adjacent to each other in the first configuration, the second zones form a central strip devoid of grooves.

The parts may also be configured so that the edges, of each part at the respective first ends, called attachment edges, have complementary shapes. The attachment edge of at least a part may comprise at least an edge portion and is configured so that the total length of the edge portions having a tangent situated in the spooling direction is less than 50%, in particular less than 20%, of the dimension of the sleeve along the spooling direction. In particular, the attachment edge may have one of the following shapes:

A zigzag shape

A sinusoidal shape

A rectilinear shape tilted relative to the spooling direction.

The disclosure also relates to an assembly of a spooling drum and a sleeve for fitting around the drum, wherein the sleeve comprises at least a groove extending along a spooling direction for receiving a conveying element to be spooled around the drum, wherein the sleeve is made of a flexible material and is configured to take a first configuration in which it forms a flat sheet, the groove extending along a direction called spooling direction, and a second configuration in which it forms a cylinder of a circumference substantially corresponding to the circumference of the drum, wherein the groove is situated on an external face of the cylinder.

The sleeve of the assembly may have any of the features disclosed above.

The disclosure also relates to an installation for lowering a conveying element in a borehole, having an assembly as disclosed above, with the sleeve fitted around the drum. The assembly may have any of the features disclosed above.

The disclosure also relates to a method for fitting a sleeve on a spooling drum having a predetermined circumference, comprising:

Forming at least a groove for receiving a conveying element along a spooling direction in a flat sheet of flexible material, Configuring the flat sheet so that a dimension of the sheet corresponds to the circumference of the drum, Bending the flat sheet so that it forms a cylinder wound around the drum so that the at least one groove extends on the side face of the drum.

Configuring the flat sheet may be performed before or after forming the groove in the sheet.

The dimension of the sheet corresponding to the circumference of the drum may be the dimension of the sheet in the spooling direction, the bending of the flat sheet being performed relative to an axis perpendicular to the spooling direction and situated in the a plan parallel to the one defined by the sheet.

The method may also comprise attaching the bent sheet on the drum with at least a temporary attaching element, spooling the conveying element around a portion of the sleeve and removing the temporary attaching element.

When the sheet comprises two parts, such as longitudinal parts, the method may comprise adjusting the position of each part on the drum before bending, in particular contacting each of the part with a respective flange of the drum.

The invention claimed is:

1. A sleeve for fitting around a spooling drum, wherein the sleeve comprises of a plurality of grooves for receiving a conveying element to be spooled around the spooling drum, wherein the sleeve is made of a flexible material and is configured so as to be able to take a first configuration in which the sleeve forms a flat sheet, the plurality of grooves extending in a direction, called a spooling direction, and a second configuration in which the sleeve forms a cylinder, wherein the plurality of grooves is situated on an external face of the cylinder, wherein the sleeve comprises at least two parts, wherein each part includes:

A first zone, comprising of the plurality of grooves extending along the spooling direction from an end to an opposite end of the sleeve relative to the spooling direction, a second zone deprived of grooves, wherein the second zone is disposed at least at a first end of each part relative to a direction perpendicular to the spooling direction.

2. The sleeve according to claim 1, wherein the sleeve is configured so that, in the second configuration, the spooling direction is perpendicular to an axis of the cylinder.

3. The sleeve according to claim 1, wherein the at least two parts are configured, so that the respective first ends of each part comprises of attachment edges, having complementary shapes.

4. The sleeve according to claim 3, wherein the attachment edges of at least two parts comprises at least an edge portion and is configured so that a total length of the edge portions having a tangent situated in the spooling direction is less than 50% of the dimension of the sleeve along the spooling direction.

5. The sleeve according to claim 4, wherein the total length of the edge portions having a tangent situated in the spooling direction is less than 20% of the dimension of the sleeve along the spooling direction.

6. The sleeve according to claim 4, wherein the attachment edges has one of the following shapes:

A zigzag shape,

A sinusoidal shape

A rectilinear shape tilted relative to the spooling direction.

7. An assembly of a spooling drum and a sleeve for fitting around the spooling drum, wherein the sleeve comprises of a plurality of grooves extending along a spooling direction for receiving a conveying element to be spooled around the spooling drum wherein the sleeve is made of a flexible material and is configured to take a first configuration in which it forms a flat sheet, the plurality of grooves extending along a direction called spooling direction, and a second configuration in which it forms a cylinder of a circumference substantially corresponding to a circumference of the spooling drum, wherein the plurality of grooves is situated on an external face of the cylinder, wherein the sleeve comprises at least two parts, wherein each part includes:

a first zone, comprising of the plurality of grooves extending along the spooling direction from an end to an opposite end of the sleeve relative to the spooling direction, a second zone deprived of grooves, wherein the second zone is disposed at least at a first end of each part relative to a direction perpendicular to the spooling direction.

8. An installation for lowering a conveying element in a borehole, comprising an assembly according to claim 7, wherein the sleeve fitted around the spooling drum.

9. The installation according to the claim 8, wherein the conveying element is a slickline cable, a wireline cable or a coiled tubing.

* * * * *